United States Patent [19]

Sathre

[11] Patent Number: 4,971,201

[45] Date of Patent: Nov. 20, 1990

[54] STACKING RIM FOR SOFT-SIDED CONTAINERS

[76] Inventor: Robert C. Sathre, 4711 Baycliffe Dr., Victoria, Minn. 55331

[21] Appl. No.: 330,610

[22] Filed: Mar. 30, 1989

[51] Int. Cl.[5] ..... B65D 21/02/6/34; B65D 5/44

[52] U.S. Cl. ..... 206/509; 206/821; 270/642; 270/533; 229/23 A; 229/198; 229/199; 229/915

[58] Field of Search ..... 206/509, 821; 229/23 A, 229/41 R, 49, 199, 915, 918, 919; 220/4 A, 73, 80

[56] References Cited

U.S. PATENT DOCUMENTS

| | | | |
|---|---|---|---|
| 2,191,291 | 2/1940 | Smith | 220/199 |
| 2,347,725 | 5/1944 | Zalkind | 229/49 |
| 2,947,462 | 8/1960 | Bostock | 229/23 A |
| 3,331,527 | 7/1967 | Kaas | 206/821 |
| 3,647,101 | 5/1972 | Hensch | 220/4 A |
| 3,687,168 | 8/1972 | Sherman | 220/80 |
| 3,797,727 | 3/1974 | Downing | 220/23 A |
| 4,172,623 | 10/1979 | Anderson | 220/80 |
| 4,503,973 | 3/1985 | Andersson | 220/23 A |
| 4,624,380 | 11/1986 | Wernette | 229/41 R |
| 4,693,387 | 9/1987 | Stonier | 220/6 |

FOREIGN PATENT DOCUMENTS

| | | | |
|---|---|---|---|
| 6612391 | 3/1968 | Netherlands | 206/821 |

*Primary Examiner*—George E. Lowrance
*Attorney, Agent, or Firm*—Douglas L. Tschida

[57] ABSTRACT

A nesting rim member mountable in circumscribing composite relation to the stacking end of a walled container. The rim includes an outer vertical flange portion which tapers inward from an upper edge to a nesting ledge. An inverted U-shaped channel portion beneath the nesting ledge extends over the container sidewalls which are recessed at their corners to receive pronged corner clips, if necessary. Each clip mates with the rim member when pressed onto the container walls. A U-shaped channel orthogonally projects inward of the container. The rim member may be extruded and pieced to the container walls or molded as a continuous ring.

17 Claims, 4 Drawing Sheets

STACKING RIM FOR SOFT-SIDED CONTAINERS

BACKGROUND OF THE INVENTION

The present invention relates to nesting containers and, in particular, to a stacking rim construction for composite containers. The rim member mounts over the upper edges of the container sidewall and the corners of the sidewalls are optionally recessed to support pronged clips that mate with the corners of the rim member in flush relation with the upper edges.

Containers useful for storing, transferring, displaying and shipping a variety of piece parts have been developed over the years using a variety of construction techniques. That is, formed wire, corrugated cardboard, plastic and sheet metal, to name a few materials, have been used to construct such containers. Except for those constructed of relatively rigid materials, most are not intended to mount in nesting or stacking relation to one another.

For example, Applicant is aware of stackable wire form containers wherein the corners of the upper and lower containers include mating protrusions and holes. Similarly, Applicant is aware of various molded plastic container constructions which include discontinuous or unconnected shelf portions to support an overlying container. Where the container includes a cover member, Applicant is also aware of cover designs which permit the upper container to rest on the closed lid. For most open topped containers, however, discontinuous resting surfaces or ledges are provided, as opposed to a peripherally continuous ledge or a rim construction which assists in the alignment of one container to the other.

Relative to composite container constructions, where the container walls and bottom are formed separately from a separately seamed rim member, similar discontinuous stacking ledges and mating protrusions/recesses have been employed. Examples of some container constructions of which Applicant is aware can be found in U.S. Pat. No's. 4,619,371 and 3,622,037.

Applicant is also aware of an extension rim which resilientlY clip mounts to a mating container rim and whereby the overall container height may be suitably adjusted, reference U.S. Pat. No. 4,572,368. Stack mounting is achieved via a horizontal flange 13 which extends between an outer vertical skirt and the inner walls of the container.

Relative to still other rim members of which Applicant is aware, U.S. Pat. No's. 4,095,719 and 3,659,774 disclose an extruded and a molded construction. Neither of these constructions however are intended for stack mounting.

Depending therefore upon the type and weight of the components to be contained, it oftentimes is desirable that the container construction permit stack mounting. This is especially true for small electronic parts, although which due to static electricity concerns must be stored within anti-static containers. Most materials useful for forming such containers, however, do not provide significant side wall strength or are too costly to fabricate as an integral unit. Thus, a composite container construction having a separately attached rim member which securely mounts to the container side walls becomes desirable. Preferably too such a rim member should provide a continuous support construction to strengthen the sidewalls and enable the stack mounting of other containers thereon.

SUMMARY OF THE INVENTION

Accordingly, it is a primary object of the present invention to provide a novel rim construction for soft-sided containers which stabilizes the sidewalls and is capable of supporting relatively heavy weights without side or end wall deformation.

It is another object of the invention to provide an extruded metallic or molded metallic, plastic or other suitable material rim member which can be fit to the sidewalls and which includes a support ledge and surrounding flared vertical skirt for centering each nested container on the lower container and preventing side-to-side slippage.

It is a further object of the invention to provide a rim member construction which is adaptable to receive corner supports which bond the rims of two adjacent sidewalls to one another and which are recessable in the side walls.

It is a yet further object of the invention to provide a rim member construction including an inwardly extending, continuous U-shaped channel recessed below the support ledge for supporting document file folders and the like.

It is a still further object of the invention to provide a rim construction which is adaptable to a variety of side wall materials for permitting bonding therebetween via available adhesives, mechanical and heat type bonding systems.

Various of the foregoing objects, advantages and distinctions of the present invention are particularly achieved in a preferred embodiment which comprises an extruded or molded aluminum rim stock which when viewed in end-on, cross section provides for an inwardly tapering vertical skirt or standoff which integrally extends above and to the side of a horizontal support or nesting ledge. The nesting ledge overlies a first inverted U-shaped channel, the walls of which mount over and in abutment with the upper edges of the container side and end walls. The channel walls are deformable by clipping or crimping and/or may include inwardly directed projections for frictionally grasping the container sidewall material upon mounting one to the other. The container side walls may be notched at their corners to receive mating clip members which include at least end portions of a slightly greater width than the rim channel such that upon fitting the rim extrusion over the container walls and clips, a secure attachment is obtained therebetween, along with a relatively rigid corner bond.

In an alternative construction, a second U-shaped channel is formed below the nesting ledge and extends inward of the container to receive and support file folder systems or other hooked contents that mount to the channel.

Still other objects, advantages and distinctions of the invention will become more apparent hereinafter upon reference to the following detailed description with respect to the appended drawings. Before referring thereto it is to be appreciated that the description is made by way of presently preferred embodiments only, which should not be interpreted in limitation of the invention. To the extent that modifications and various alternative constructions have been contemplated, they are described as appropriate.

DESCRIPTION OF THE PREFERRED EMBODIMENT

Figure 1:
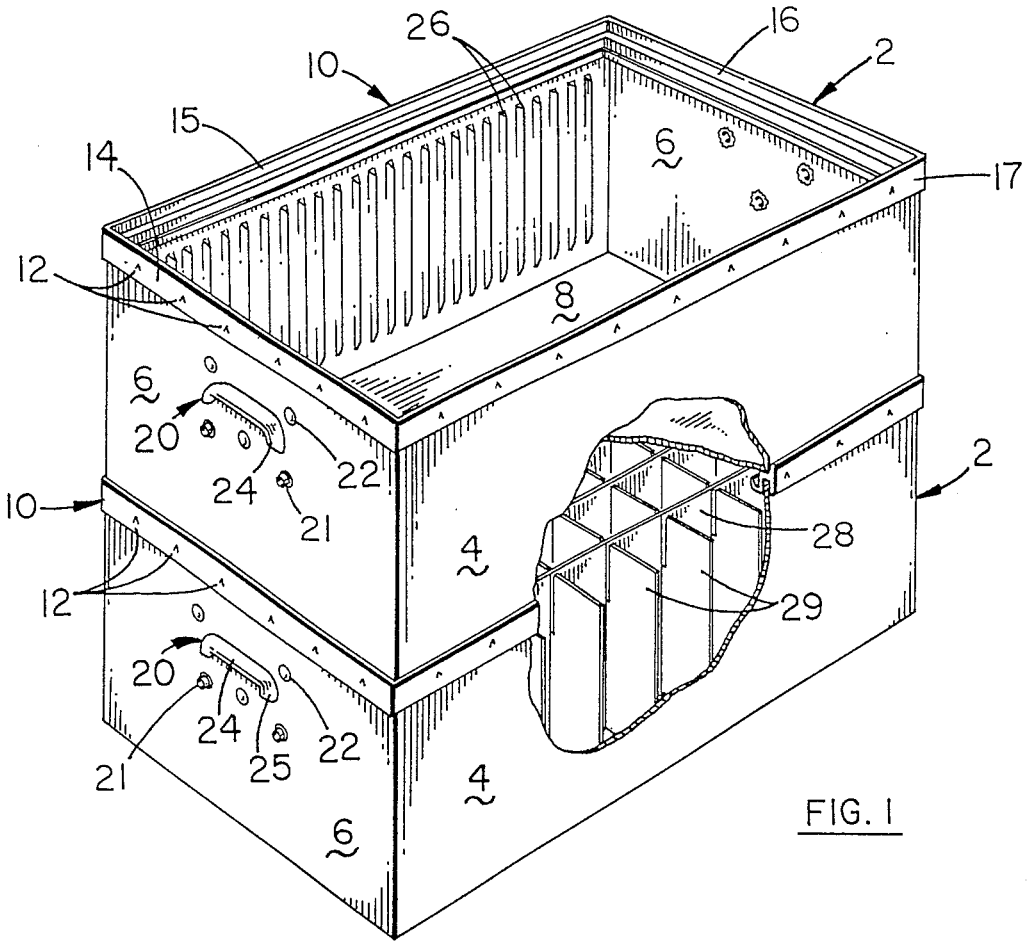
FIG. 1 shows an isometric view in cutaway of a pair of composite containers with different interior treatments incorporating the improved rim extrusion of the present invention.

Referring to FIG. 1, an isometric view is shown of a pair of multi-purpose, stackable storage/transfer containers 2 of the present invention. The side 4, end 6 and bottom 8 walls of each of the containers 2 are fabricated from profile-extruded sheets of polypropylene copolymer which are folded to shape. That is, a static electricity free corrugated plastic.

Each container 2 includes an extruded, multi-section rim 10 which is crimped to the container walls at a number of crimp points 12 where the rim material is cut and bent inward to contact and restrain the wall material. The corners of the extruded rim portions 14, 15, 16 and 17, which comprise each rim 10, are additionally welded to one another and a mating corner clip member 18 (reference FIG. 4) is press fit at each corner into an inverted U-shaped channel portion 19 which mounts over the container sidewall material (reference FIG. 2). The details of the corner construction will however become more apparent hereinafter with reference to FIGS. 2–5.

Otherwise, each of the containers 2 includes a pair of molded, end mounted handles 20 which are secured to the end walls via rivet fasteners 22. Each handle 20 is molded in a separate operation. A complementary hole 25 in the outer container end walls (reference FIG. 3) permits the mounting of the handle to the end walls. Other than for a grab or hand-hold portion 24, each handle 20 provides for a surrounding plate-like extension (not shown) which mounts between overlapped portions of the end wall material and through which the rivets 22 pass to secure each handle 20 to the container 2. It is to be appreciated, however, that a variety of other handle treatments may be included in each container 2 from mere cutouts 25 to integrally molded handles formed with the container walls, such as where a molded plastic wall construction is used. Wire form and cast handles of various types may also be incorporated into the container.

A pair of snap clips 21 permit mounting of a windowed pocket (not shown) to the end wall. However, other fasteners may be used or the pockets may be formed with or adhesively secured to the walls.

Mounted interiorly of the upper container 2, along the opposite sidewalls, are separately molded members 26 which define a plurality of vertical slide channels. Aternatively, the slide channels 26 can be integrated into the sidewalls. Each slide channel 26 may receive, for example, the edges of a printed circuit board or alternatively a divider member 28 which extends across the container interior and relative to which one or more transverse dividers 29 may also mount. In the latter regard, attention is directed to the interior of the lower container 2 which shows such a compartmentalized interior. Thus, it is similarly to be appreciated that a variety of interior treatments may be included within each container 2, depending upon a user's needs.

Of particular significance to the present invention is the combination of the presently improved rim extrusion 10 with the corner clips 18 which stabilize the container walls. A relatively rigid container construction is achieved using relatively soft-sided wall materials which otherwise tend to bow outward/inward in normal use. As presently constructed, however, the extrusion construction and corner clips 18 provide a much improved and sturdier anti-static container 2 capable of supporting the weight of other stacked containers.

Although the present rim member 10 has been developed for a particular sidewall material, it is to be appreciated a variety of materials may be combined therewith. These materials may range from single layer plastics to laminated materials to corrugated fiber/paper board materials to vacuum or stamp molded materials to metal or any other material which may be suitably formed to a desired container shape. Although too the rims 10 of the containers 2 of FIG. 1 are shown as a multi-sectioned welded construction, a single seam extruded construction and a molded continuous ring assembly construction having no seams are shown with respect to FIGS. 6 and 9.

Figure 3:
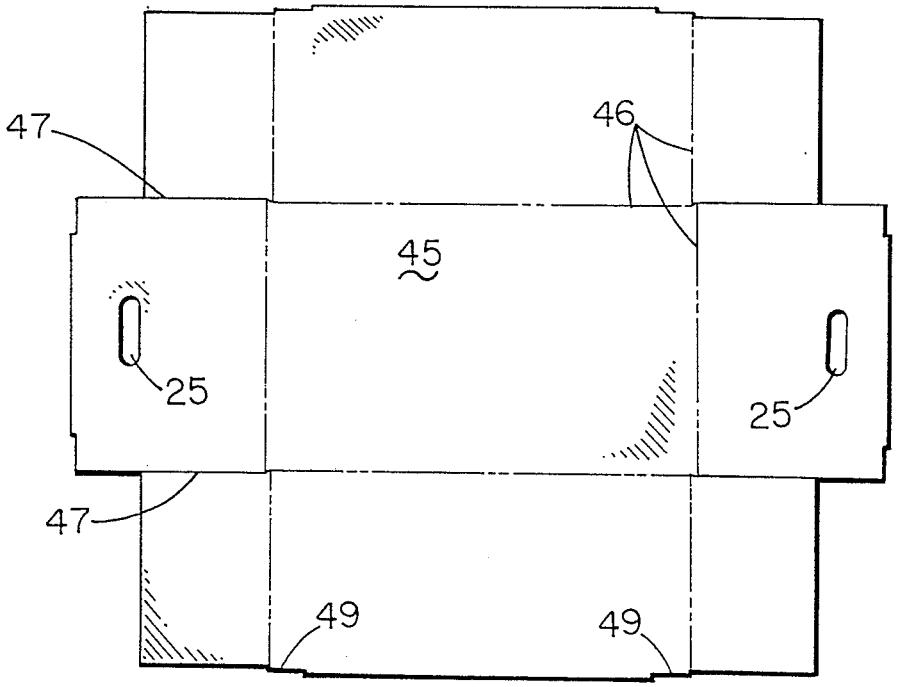
FIG. 3 shows a plan view of the unfolded, scored container material which forms the bottom and side container walls.

Turning attention to FIGS. 2 through 5, FIGS. 2*a* and 2*b*, 4 and 5 show particular detailed views of the cross sectional extrusion shape of the rim 10, the corner clip 18 and the mounting relation of one to the other. FIG. 3 shows a plan view of the dye-cut material used to form the walls 4, 6 and 8 of a typical container construction.

Figure 2A:
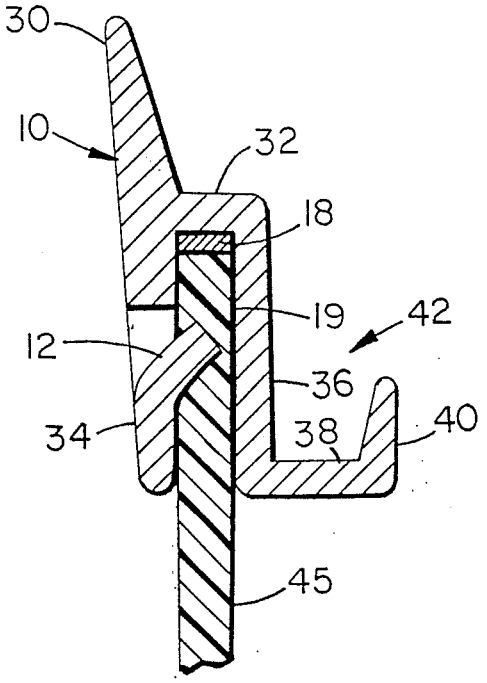
FIG. 2*a* shows a detailed cross section view through the rim extrusion of the present invention.

With attention however first directed to FIG. 2*a*, it is to be noted that the rim member 10 is presently extruded from a molten aluminum material which is drawn through an extrusion dye to form the cross sectional shape shown. That is, a vertical, inwardly tapered flange or skirt portion 30 is formed which at its lower end meets a horizontal support ledge portion 32. Extending downward from the support ledge 32 are inner and outer vertical wall portions 34 and 36 which form the inverted U-shape channel 19.

Figure 7:
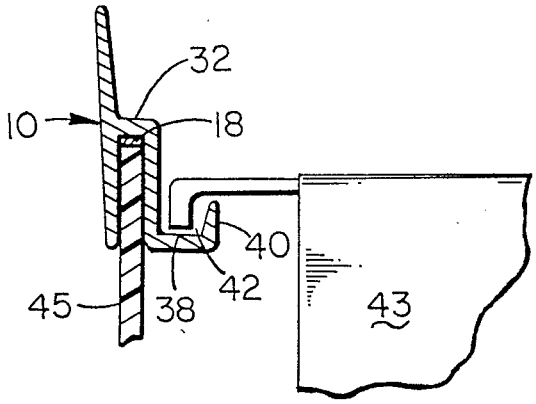
FIG. 7 shows an alternative rim member profile for a filing container system.

The width dimension of the channel 19 is sized to permit a slip fit mounting over the particular wall stock material 45. .Extending inwardly of the container from the channel wall 36 is a second horizontal ledge 38 and from an outer end of which rises a slight vertical flange 40. A second U-shaped channel 42 is thus formed which not only adds rigidity to the rim extrusion 10, as a whole, but also acts as a support rail for various interior container constructions. For example and with additional attention to FIG. 7, upon recessing this inner rail 42 below the ledge 32, the inner rail 42 may be used to support document file folders such as sold under the brand name PENDAFLEX. Alternatively, hooks provided on stored parts may be secured to the rails 42 and/or other interior treatments.

From FIG. 2*a*, a better view of the crimping of the outer channel wall 34 to the sidewall material 45 can be seen. Each crimp point 12 comprises a portion of the outer wall 34 which is cut and bent inward at an approximate 45 degree angle to pierce the container wall material 45. A mechanical bond is thereby obtained which discourages detachment, such as where the rim 10, instead of the handles 20, is grasped and the counteracting weight within the container seeks to cause separation of the rim 10 from the container walls. Multiple crimp points 12 discourage such a separation.

Figure 2B:
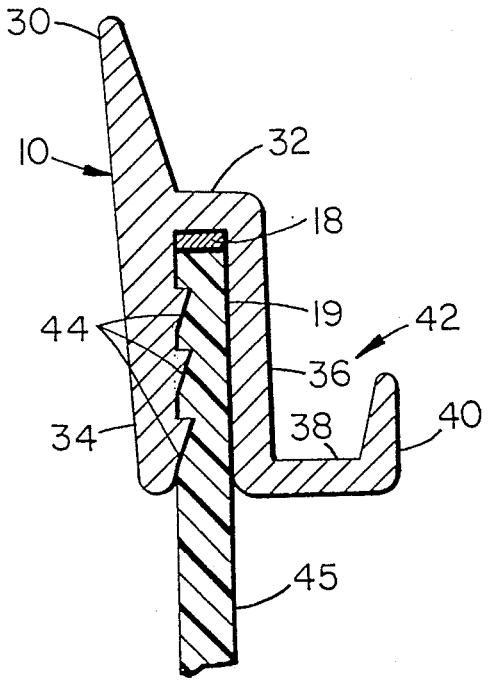
FIG. 2*b* shows a detailed cross-section view through an alternative rim extrusion.

Moreover and as further shown in FIG. 2*b*, a plurality of horizontal rails 44 with pointed or sharpened inner ends might be coextruded with either or both of the channel walls 34, 36. Such rails are shaped to provide an inwardly tapering edge, which as with the crimps 12 and upon fitting the rim 10 over the container walls, tends to grasp the container wall material 45 and discourage withdrawal.

Provided about the periphery of the rim extrusion is the tapered vertical skirt or flange portion 30. The inner surface is outwardly flared at a 10 to 20 degree angle from vertical. This skirt portion not only strengthens the rim 10, but also induces the desired alignment of overlying stacked containers, while preventing side-to-side dislodgement, once nested within one another. Although one construction is shown, it is to be appreciated the taper of the flange may be varied as desired.

Mounted at each corner between the upper end of the wall stock material 45 and the horizontal support ledge 32 is the clip member 18 which as shown is recessed into the wall stock material 45 such that the top of the clip 18 and wall 45 each abut the bottom of the ledge 32. Thus, no space is provided between the rim extrusion 10 and wall 45 which might over time induce separation or undesired flexing. With attention to FIG. 3, such a fitting is achieved by forming recessed or notched cuts 49 at each corner in the wall stock material 45 as the material is dye-cut to shape. Also formed in the material are slit lines 47 and score lines 46 which permit folding the material to the container shapes of FIG. 1.

Figure 4:
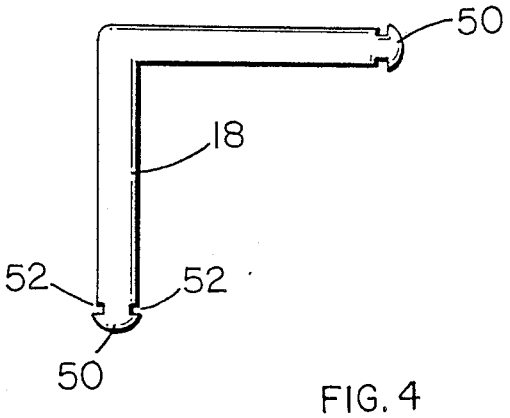
FIG. 4 shows a plan view of one of the corner clip members.
Figure 5:
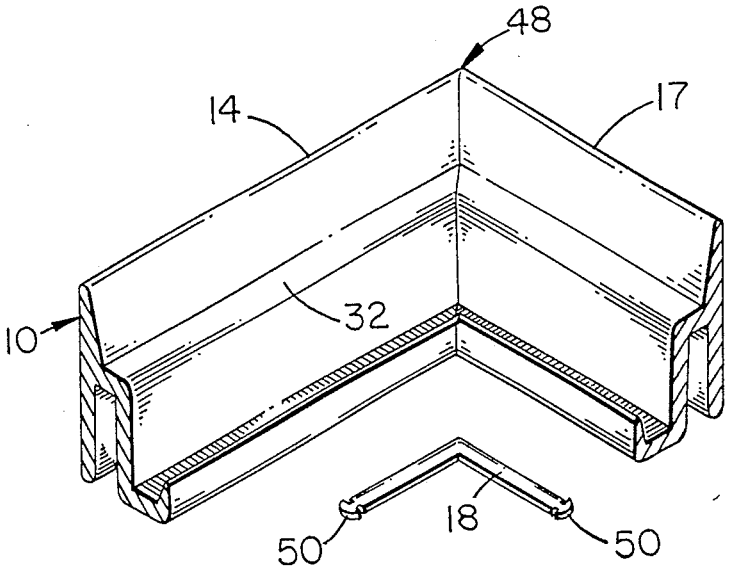
FIG. 5 shows an isometric view in exploded assembly of a pair of welded, corner extrusions and the support clip.

With additional attention directed to FIGS. 4 and 5, an exploded assembly view is shown of a 90 degree corner clip 18 relative to a typical mitered corner 48. As mentioned, upon forming up the container walls, the clip 18 is supported at the corner notches 49 as the inverted channels 19 of the rim sections 14, 15, 16 and 17 are pressed onto the formed container walls. Formed at each end of each clip 18 is a hemispherical tip portion 50 having outer tips 52 which extend slightly beyond the width of the channelway 19 such that the tips 52 form a mechanical bond with the rim extrusion 10, when pressed together.

While for the present construction, the hemispherical tips 50 have proven adequate, it is to be appreciated a clip construction having multiple tip projections along the clip edges may be preferred, since as with the interior rails 44 of FIG. 2, a greater contact surface area is obtained and corresponding stronger bond. As more contact points are added, however, it becomes more difficult to press the rim 10 onto the container. In lieu also of the mechanical bonding disclosed, it is to be further appreciated that a variety of chemical adhesives compatible with the container wall material and rim 10 may suitably be combined therewith. Moreover, a variety of welding techniques such as ultrasonic bonding etc. may be employed.

Even though, too, the clips 18 sufficiently secure each corner, the rim portions at each mitered corner are also welded along the outer surface of their skirts 30, such as where the edge portions 14 and 17 contact one another to further strengthen the corners. The welding operations however require additional time and accordingly a single seam or a no seam rim construction is preferable.

Figure 6:
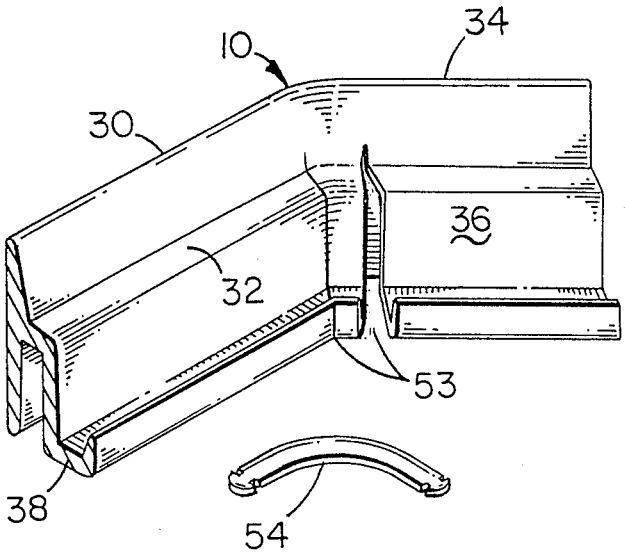
FIG. 6 shows an isometric view in partial cutaway of a rounded, extruded corner and related corner clip.

FIG. 6 accordingly discloses a single seam rim construction wherein each corner of the container is formed with a rounded configuration, as opposed to a 90 degree configuration. Such a construction is obtained by cutting adjacent V-shaped vertical notches 53 through the inner surface of the rim member 10, while slightly scoring the inner surface of the channel wall 34. When the notched rim extrusion is bent to shape, the edges of the notches 53 align to form a closed seam, one of which is shown. Thus, as the notched extrusion is bent, the outer vertical flange walls 30, 34 and 36 become rounded as shown.

Depending upon the spacing and number of notches 53, a desired corner shape can be achieved. For example, in lieu of letting the notches 53 in adjacent relation to each other, a slight space might be provided therebetween. A greater radiused corner bend is thus obtained. In any case, however, a compatibly shaped corner clip member 54 may also be used to secure and strengthen the rounded corner construction.

Figure 8:
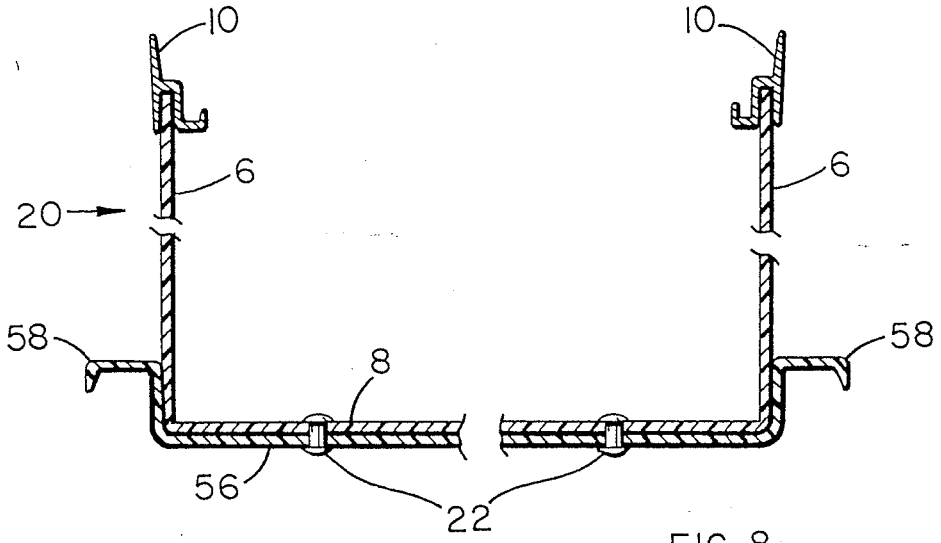
FIG. 8 shows a cross section view through a container including a bottom wear plate with hand rails.

With attention next directed to FIG. 8, a cross section view is shown through yet another alternative container construction which incorporates the above referenced rim member 10. This assembly particularly includes a bottom wear plate 56 which is constructed of a metal or any other material having desired abrasion resistance. That is, where the container 2 may encounter relatively rough treatment, the inclusion of a separate bottom lamination protects the container bottom 8 over time. The plate 56 is typically formed with a complimentary shape to the container bottom 8, although may exhibit a distinguishable shape. Also provided about the periphery of the plate 56 is a surrounding rail portion 58 which may be used as a hand-hold, when necessary. Alternatively, the rails 58 can rest upon the vertical skirt 30 of the next lower container, as the plate 56 rests on the nesting ledge 32.

Figure 9:
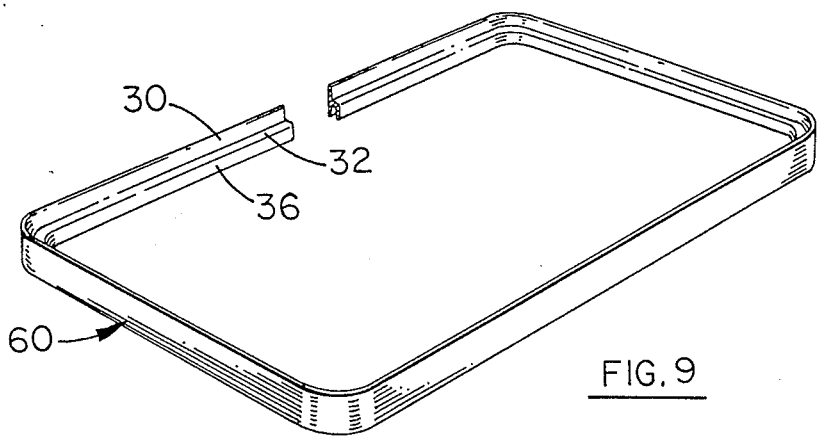

FIG. 9, lastly, discloses a continuous, ring formed rim member 60 which can be injection molded or formed using a variety of other techniques. It does not provide for an inner channel 42, but does utilize compatible corner clips to strengthen each corner of the container. In various containers, this rim 60 is desirable, since it does away with any seams. It also provides a skirt portion 30 to permit the desired nesting function.

While the present invention has been described with respect to its presently preferred and various alternative embodiments, it is to be appreciated still other embodiments might suggest themselves to those of skill and the art. Accordingly, it is contemplated that the following claims should be interpreted to include all those equivalent embodiments within the spirit and scope thereof.

What is claimed is:

1. A material handling container comprising:

(a) a bottom wall and a plurality of vertical side walls;

(b) a rim member including a first channelway which mounts over an upper edge of each of the side walls to circumscribe all of the side walls and a plurality of vertical notches let substantially through the first channelway at each of a plurality of corners between adjacent sidewalls such that the rim member may be folded to conform to the corners; and (c) means for securing said rim member to each side wall including a plurality of corner clips, wherein each corner clip mounts within said first channelway at each corner.

2. Apparatus as set forth in claim 1 wherein said rim member is formed of extruded aluminum and mating surfaces of said notches at each corner are welded to one another.

3. Apparatus as set forth in claim 1 wherein said rim member generally exhibits an h-shape when viewed in a plane orthogonal to each sidewall and wherein a first relatively longer vertical flange portion mounts to the exterior side of the container and includes a portion having a surface which tapers inward from an overlying end to a lower horizontal shelf portion such that the bottom of a second overlying container is guided into stacked registration with the horizontal shelf portion by the tapered surface and restrained from lateral movement.

4. Apparatus as set forth in claim 3 wherein each rim member includes a horizontal flange portion which projects interiorly of the container from a second vertical flange portion and terminates in a third upwardly extending vertical flange portion whereby a second extends upward adjacent the sidewall containing channelway.

5. Apparatus as set forth in claim 1 wherein at least one wall of the sidewall contacting channelway is crimped after being mounted over said side walls such that a plurality of wall portions are bent inward to pierce the container side walls.

6. Apparatus as set forth in claim 1 wherein a sidewall contacting surface of said first channelway includes at least one coextensive ridged protrusion which compressively contacts the sidewalls and whereby the rim member is secured thereto.

7. Apparatus as set forth in claim 1 wherein the rim member is molded as an endless ring.

8. Apparatus as set forth in claim 1 wherein each corner clip includes a plurality of portions having a span greater than the spacing between sidewall contacting surfaces of the channelway and which clip portions embed into said rim member upon mounting the rim member over the sidewalls.

9. Apparatus as set forth in claim 1 wherein a notch is formed in the upper corner of each side wall to a depth whereby the upper inner surface of said first channelway rests of the upper side wall edges and corner clips.

10. Apparatus as set forth in claim 1 including a plurality of wall members extending across the container interior and interlocking with one another to define a plurality of compartment portions.

11. Apparatus as set forth in claim 1 including a second bottom wall secured to the bottom wall and formed of a relatively stronger material than the material from which the container is formed and having portions which extend upward along the side walls.

12. Apparatus as set forth in claim 11 wherein said second bottom wall includes a horizontal flange portion which projects outward from the container side walls.

13. Apparatus as set forth in claim 8 wherein each corner clip exhibits an L-shape and opposite ends of each corner clip include a semi-circular portion having a radius of curvature greater than the span between the sidewall contacting surfaces of the channelway.

14. A material handling container comprising:

(a) a planar sheet stock material cut and partially scored to fold into a bottom wall and a plurality of vertical side walls;

(b) a rim member having a channelway mounting over an upper edge of each of the side walls to circumscribe all of the side walls and exhibiting an h-shape when viewed in a plane orthogonal to each side wall, wherein an interior surface of an uppermost vertical flange portion concentrically surrounds the container side walls and tapers inward to a horizontal shelf portion and whereby secured registration is promoted between stacked containers;

(c) a plurality of corner clips, each corner clip mounting within the first channelway of said rim member intermediate the upper edges of a corner formed between adjacent side walls and wherein each clip includes a plurality of portions having a span greater than the span between sidewall contacting surfaces of the channelway and which portions embed into said channelway upon mounting the rim member over the sidewalls;

(d) means for securing said rim member to each side wall; and (e) handle means for hand grasping said container.

15. A stackable material handling container comprising:

(a) a bottom wall and a plurality of vertical side walls;

(b) a rim member including a channelway mounting over an upper edge of each of the side walls to circumscribe all of the side walls and having a horizontal shelf portion overlying said channelway and a vertical flange portion rising from said shelf portion and wherein a surface of said vertical flange portion tapers inward from an overlying end to the horizontal shelf portion and such that the bottom of a second container is guided into stacked registration with the horizontal shelf portion by the tapered surface;

(c) means for securing said rim member to each side wall; and (d) handle means for grasping the container.

16. Apparatus as set forth in claim 15 including a plurality of corner clips, each corner clip mounting within said channelway intermediate the upper edges of a corner formed between adjacent side walls and wherein each clip includes at least a portion of a span greater than the span between sidewall contacting surfaces of the channelway and which portions embed into said channelway upon mounting the rim member over the sidewalls.

17. Apparatus as set forth in claim 15 wherein a sidewall contacting surface of said first channelway includes at least one coextensive ridged protrusion which compressively contacts the sidewalls and whereby the rim member is secured thereto.

* * * * *